US008977380B2

(12) United States Patent
Abe

(10) Patent No.: US 8,977,380 B2
(45) Date of Patent: Mar. 10, 2015

(54) SEWING MACHINE, COMPUTER-READABLE MEDIUM STORING SEWING PROGRAM, AND SEWING METHOD

(71) Applicant: Brother Kogyo Kabushiki Kaisha, Nagoya-shi, Aichi-ken (JP)

(72) Inventor: Daisuke Abe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/292,345

(22) Filed: May 30, 2014

(65) Prior Publication Data

US 2015/0005921 A1 Jan. 1, 2015

(30) Foreign Application Priority Data

Jun. 28, 2013 (JP) ..... 2013-135994

(51) Int. Cl.
*D05C 5/02* (2006.01)
*D05B 19/08* (2006.01)
*D05B 19/10* (2006.01)

(52) U.S. Cl.
CPC ..... *D05B 19/08* (2013.01); *D05B 19/10* (2013.01)
USPC ..... 700/138; 112/470.01

(58) Field of Classification Search
USPC ..... 700/136–138; 112/102.5, 470.01, 112/470.04, 470.06, 475.18, 475.19
See application file for complete search history.

(56) References Cited

U.S. PATENT DOCUMENTS

| | | | | |
|---|---|---|---|---|
| 5,775,240 | A * | 7/1998 | Hara et al. | 112/102.5 |
| 5,790,700 | A | 8/1998 | Saito | |
| 5,991,702 | A * | 11/1999 | Saito | 702/155 |
| 8,733,260 | B2 * | 5/2014 | Takahata et al. | 112/78 |
| 2008/0127870 | A1 * | 6/2008 | Tashiro | 112/470.01 |

FOREIGN PATENT DOCUMENTS

| | | |
|---|---|---|
| JP | A-62-92085 | 4/1987 |
| JP | A-8-227459 | 9/1996 |
| JP | A-2002-126381 | 5/2002 |

* cited by examiner

*Primary Examiner* — Nathan Durham
(74) *Attorney, Agent, or Firm* — Oliff PLC

(57) ABSTRACT

The memory stores computer-readable instructions causing the sewing machine to perform operations including: extracting feature points of a design based on a captured image; extracting feature points of a unit design; generating feature points of a symmetrical design; cross-checking the extracted feature points of the design and the generated feature points of the symmetrical design; determining an arrangement of an embroidery pattern with respect to the symmetrical design; and causing a sewing portion to sew the embroidery pattern.

18 Claims, 13 Drawing Sheets

FIG. 11

310

| N | ANGLE $\alpha 2$ | FLAG $\beta 2$ | CENTER COORDINATES 121 |
|---|---|---|---|
| 1 | 0° | 0 | P1 (X1, Y1) |
| 2 | 60° | 0 | P2 (X2, Y2) |
| 3 | 120° | 0 | P3 (X3, Y3) |
| 4 | 180° | 0 | P4 (X4, Y4) |
| 5 | 240° | 0 | P5 (X5, Y5) |
| 6 | 300° | 0 | P6 (X6, Y6) |

SEWING MACHINE, COMPUTER-READABLE MEDIUM STORING SEWING PROGRAM, AND SEWING METHOD

CROSS-REFERENCE TO RELATED APPLICATION

This application claims priority to Japanese Patent Application No. 2013-135994, filed Jun. 28, 2013. The disclosure of the foregoing application is incorporated herein by reference in its entirety.

BACKGROUND

The present disclosure relates to a sewing machine capable of sewing an embroidery pattern, a computer-readable medium storing a sewing program, and a sewing method.

In related art, a sewing machine is known that is capable of sewing an embroidery pattern.

For example, the known sewing machine is provided with a device that regularly arranges an embroidery pattern in a plurality of positions in accordance with an arrangement type that is selected from among arrangement types that have been determined in advance. The sewing machine sews the embroidery pattern in a plurality of positions on a work cloth in accordance with the selected arrangement type.

SUMMARY

When an embroidery pattern is sewn on a work cloth on which a design has been formed in advance, there are cases in which a user wants to arrange the embroidery pattern in accordance with the design. However, when a position of the embroidery pattern is set using the known sewing machine, it is necessary for the user to use a special template and to perform positioning by visual check, resulting in complicated operations.

Various embodiments of the broad principles derived herein provide a sewing machine, a computer-readable medium string a sewing program, and a sewing method that are configured to sew a plurality of embroidery patterns by automatically arranging the plurality of embroidery patterns in appropriate positions on a work cloth on which a design has been formed.

The embodiments herein provide a sewing machine that includes an image capturing portion, a sewing portion, a processor, and a memory. The image capturing portion is configured to capture an image of a design that is formed in advance on a work cloth. The sewing portion is configured to sew an embroidery pattern. The memory is configured to store computer-readable instructions, the computer-readable instructions, when executed by the processor, causing the sewing machine to perform operations including: extracting feature points of the design based on the image captured by the image capturing portion; extracting, from among the extracted feature points of the design, feature points of a unit design, the unit design being a part of the design; generating, based on the extracted feature points of the unit design, feature points of a symmetrical design, the symmetrical design being a design symmetrical to the unit design; cross-checking the extracted feature points of the design and the generated feature points of the symmetrical design; determining an arrangement of the embroidery pattern with respect to the symmetrical design, based on a result obtained by the cross-checking the feature points of the design and the feature points of the symmetrical design; and causing the sewing portion to sew the embroidery pattern based on the determined arrangement of the embroidery pattern with respect to the symmetrical design.

The embodiments described herein also provide a non-transitory computer readable medium storing a sewing program. The sewing program includes computer-readable instructions to be executed by a processor of a sewing machine. The sewing machine includes an image capturing portion and a sewing portion. The image capturing portion is configured to capture an image of a design that is formed in advance on a work cloth. The sewing portion is configured to sew an embroidery pattern. The sewing program includes computer-readable instructions to cause the processor to perform the steps of: extracting feature points of the design based on the image captured by the image capturing portion; extracting, from among the extracted feature points of the design, feature points of a unit design, the unit design being a part of the design; generating, based on the extracted feature points of the unit design, feature points of a symmetrical design, the symmetrical design being is a design symmetrical to the unit design; cross-checking the extracted feature points of the design and the generated feature points of the symmetrical design; determining an arrangement of the embroidery pattern with respect to the symmetrical design, based on a result obtained by the cross-checking the feature points of the design and the feature points of the symmetrical design; and causing the sewing portion to sew the embroidery pattern based on the determined arrangement of the embroidery pattern with respect to the symmetrical design.

The embodiments described herein also provide a sewing method that includes: extracting feature points of a design based on an image captured by an image capturing portion, the image capturing portion being configured to capture the image of the design that is formed in advance on a work cloth; extracting, from among the extracted feature points of the design, feature points of a unit design, the unit design being a part of the design; generating, based on the extracted feature points of the unit design, feature points of a symmetrical design, the symmetrical design being a design symmetrical to the unit design; cross-checking the extracted feature points of the design and the generated feature points of the symmetrical design; determining an arrangement of an embroidery pattern with respect to the symmetrical design, based on a result obtained by the cross-checking the feature points of the design and the feature points of the symmetrical design; and causing a sewing portion to sew the embroidery pattern based on the determined arrangement of the embroidery pattern with respect to the symmetrical design, the sewing portion being configured to sew an embroidery pattern.

BRIEF DESCRIPTION OF THE DRAWINGS

Embodiments of the present disclosure will be described below in detail with reference to the accompanying drawings in which:

FIG. 11 is a diagram showing six groups of feature points;

DETAILED DESCRIPTION

Figure 1:
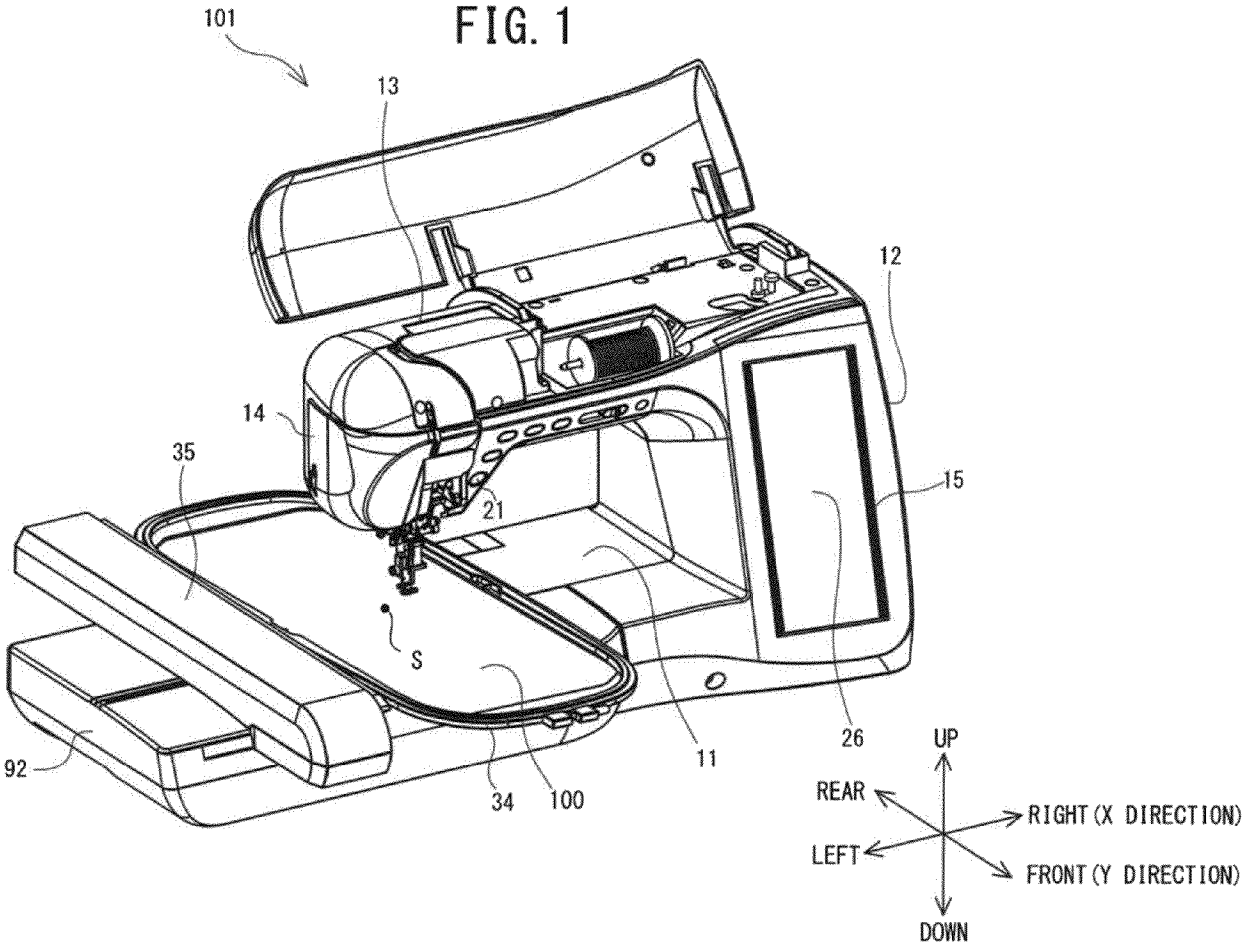
FIG. 1 is a front view of a sewing machine.

Hereinafter, an embodiment of a sewing machine 101 that embodies the present disclosure will be explained. As shown in FIG. 1, the sewing machine 101 is provided with a bed portion 11, a pillar 12, an arm portion 13 and a head portion 14. The bed portion 11 is a base portion of the sewing machine 101. The bed portion 11 has a flat surface on which a work cloth 100 can be placed. The pillar 12 extends from the bed portion 11. The arm portion 13 extends from the pillar 12 such that the arm portion 13 faces the bed portion 11.

Directions in the present embodiment are defined as follows. The direction in which the pillar 12 extends from the bed portion 11 is the upward direction, and the direction opposite to the upward direction is the downward direction. The direction in which the arm portion 13 extends from the pillar 12 is the left direction, and the direction opposite to the left direction is the right direction. The direction that is orthogonal to the left-right direction and to the up-down direction is the front-rear direction.

When an embroidery pattern is sewn using the sewing machine 101, an embroidery frame 34 is mounted on an embroidery frame moving device 92. The embroidery frame 34 is disposed above the bed portion 11 and the main body of the embroidery frame moving device 92. The embroidery frame 34 holds the work cloth 100. The embroidery frame moving device 92 is mounted to the left of the bed portion 11. Although details will be described later, the embroidery frame moving device 92 moves the embroidery frame 34 in an X direction and a Y direction.

Although not shown in the drawings, in addition to the embroidery frame 34, the sewing machine 101 is provided with a plurality of types of embroidery frames that are different in size and shape. The sewing machine 101 sets a sewable area within the embroidery frame, in accordance with the type of the embroidery frame mounted on the embroidery frame moving device 92. In the explanation below, the explanation will be made using the embroidery frame 34, for explanatory convenience. The embroidery frame 34 has a known structure in which an inner frame and an outer frame clamp and hold the work cloth 100, and a detailed explanation of the embroidery frame 34 is omitted.

The embroidery frame moving device 92 is provided with a carriage cover 35 that extends in the front-rear direction. The carriage cover 35 is provided on an upper portion of the main body of the embroidery frame moving device 92. A Y axis moving mechanism (not shown in the drawings) is provided inside the carriage cover 35. The Y axis moving mechanism moves a carriage (not shown in the drawings) in a Y direction (the front-rear direction of the sewing machine 101). The embroidery frame 34 can be mounted on and removed from the carriage. Therefore, the Y axis moving mechanism moves the embroidery frame 34 in the Y direction.

A mounting portion (not shown in the drawings) is provided to the right of the carriage. The mounting portion protrudes to the right with respect to the right side surface of the carriage cover 35. The mounting portion mounts the embroidery frame 34.

An X axis moving mechanism (not shown in the drawings) is provided inside the main body of the embroidery frame moving device 92. The X axis moving mechanism moves the carriage, the Y axis moving mechanism and the carriage cover 35 in an X direction (the left-right direction of the sewing machine 101). The embroidery frame 34 can be mounted on and removed from the carriage. Therefore, the X axis moving mechanism moves the embroidery frame 34 in the X direction.

Figure 2:
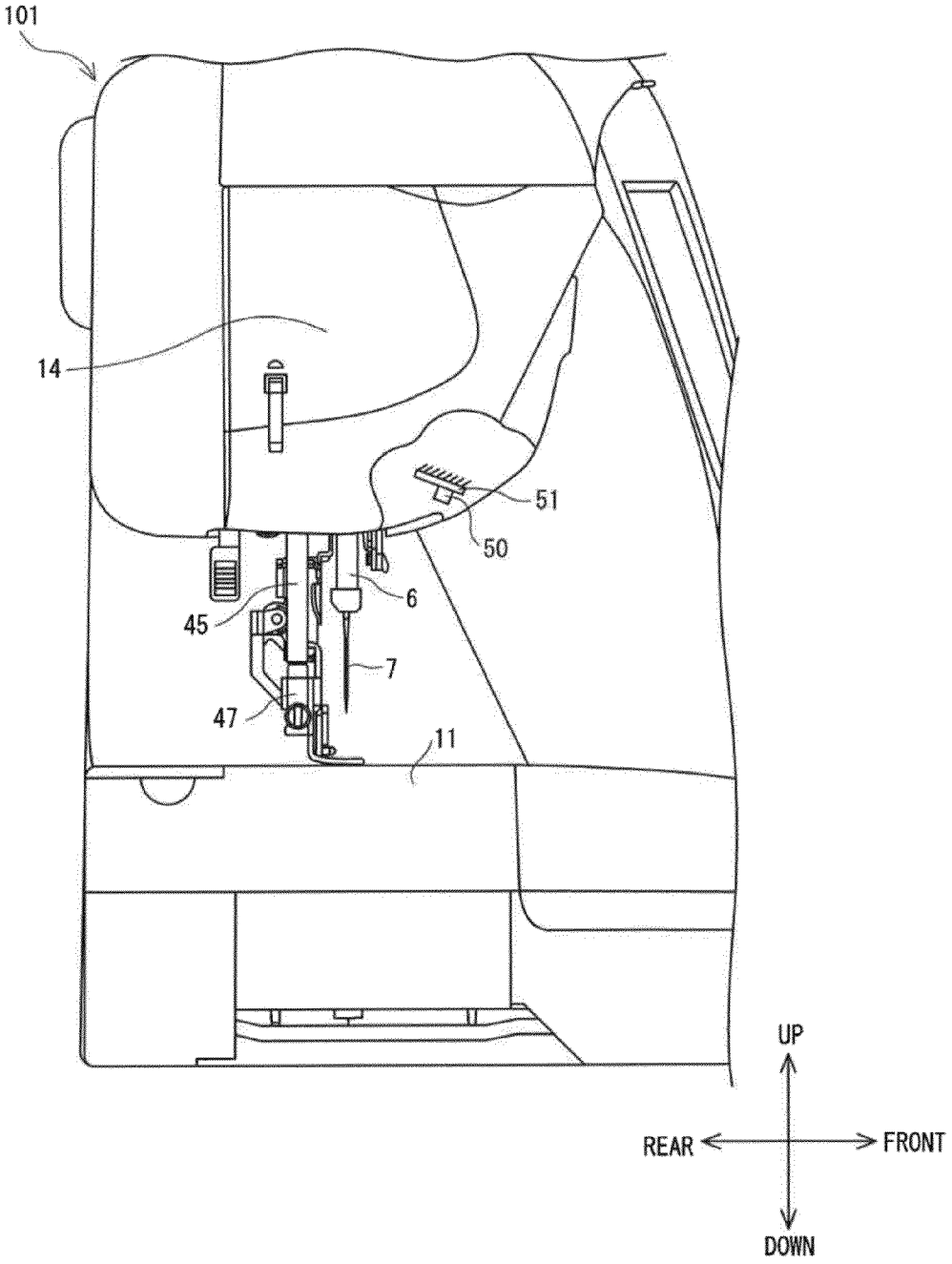
FIG. 2 is a left side view of the sewing machine.

While moving the embroidery frame 34 in the X direction and the Y direction, the sewing machine 101 drives a needle bar 6 shown in FIG. 2 and a shuttle mechanism (not shown in the drawings) that is provided inside the bed portion 11. By doing this, a desired embroidery pattern is sewn on the work cloth 100 held by the embroidery frame 34.

A liquid crystal display 15 is provided on the front surface of the pillar 12. The liquid crystal display 15 has a vertically long rectangular shape. The liquid crystal display 15 displays images of various items, such as a plurality of types of patterns, command names to execute various types of functions, various types of messages and the like. A transparent touch panel 26 is provided on the front surface of the liquid crystal display 15. A user can select a pattern to be sewn or a command to be executed, if the user touches a portion of the touch panel 26 that corresponds to the item displayed on the liquid crystal display 15, using a finger or a special touch pen (not shown in the drawings).

A sewing start-and-stop switch 21 is provided on a lower portion of the front surface of the arm portion 13. The sewing start-and-stop switch 21 starts or stops the sewing by the sewing machine 101. When the sewing start-and-stop switch 21 is depressed, a command to start or stop sewing is input to a control portion 60 shown in FIG. 3.

The needle bar 6, a sewing needle 7, a presser bar 45 and a presser foot 47 will be explained with reference to FIG. 2. In FIG. 2, for explanatory convenience, illustrations of the embroidery frame moving device 92 and the embroidery frame 34 are omitted. The needle bar 6 and the presser bar 45 are provided below the head portion 14. The sewing needle 7 is fixed to the lower end of the needle bar 6. The presser foot 47 is fixed to the lower end of the presser bar 45. The presser foot 47 presses the work cloth 100.

An image sensor 50 is provided on a front lower portion inside the head portion 14. The image sensor 50 captures an image of the top surface of the work cloth 100. An area inside the embroidery frame 34 that is captured by the image sensor 50 is called a capturing area. The image sensor 50 is provided with a CMOS sensor that captures images, and a control circuit that controls the CMOS sensor. The image sensor 50 is fixed to a support frame 51. The support frame 51 is attached to a frame (not shown in the drawings) of the sewing machine 101. A sewing portion includes the embroidery frame 34, the embroidery frame moving device 92, the carriage cover 35, the X axis moving mechanism, the Y axis moving mechanism, an X axis motor 83, a Y axis motor 84, the needle bar 6 and the shuttle mechanism.

Figure 3:
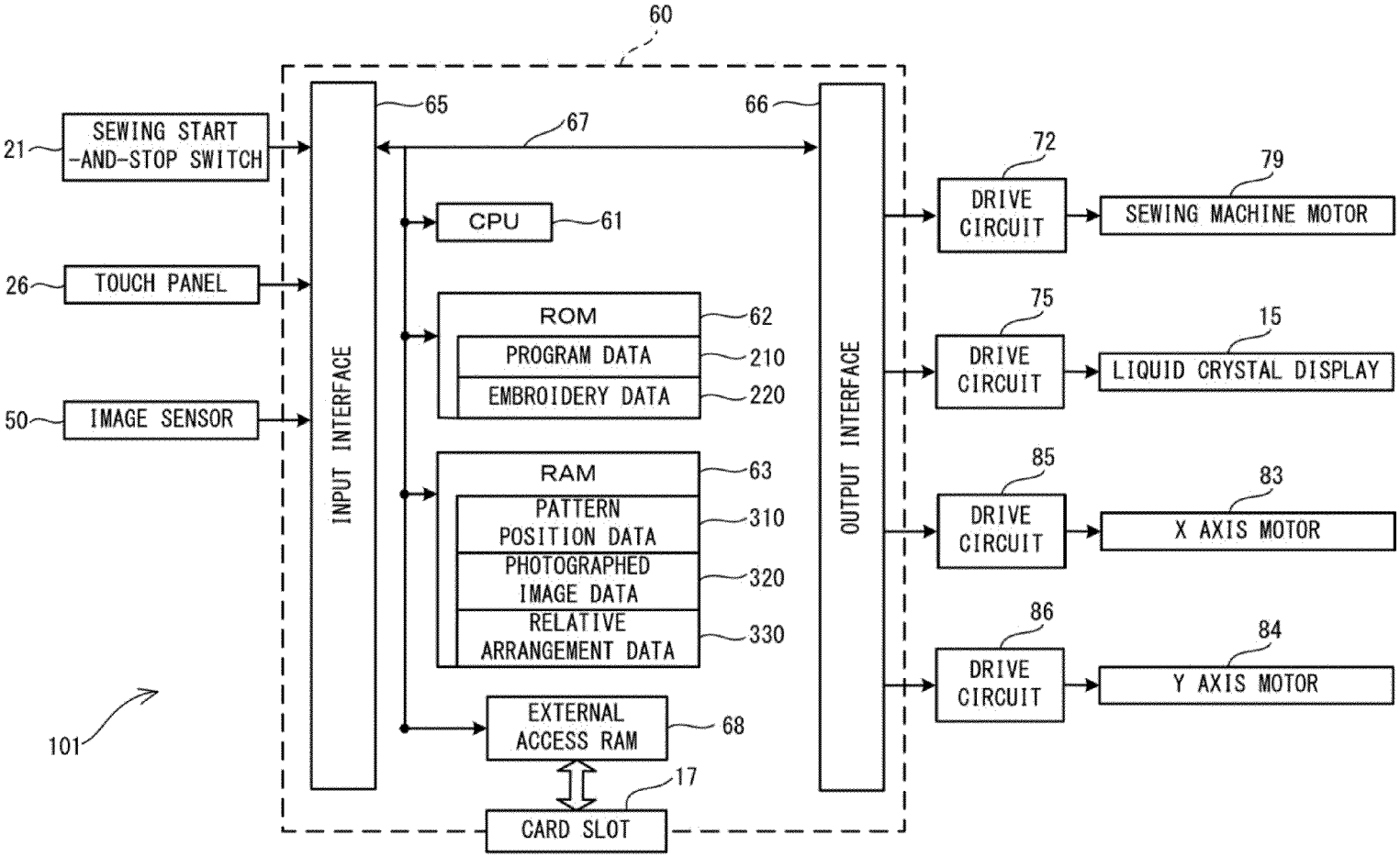
FIG. 3 is a block diagram showing an electrical configuration of the sewing machine.
Figure 4:
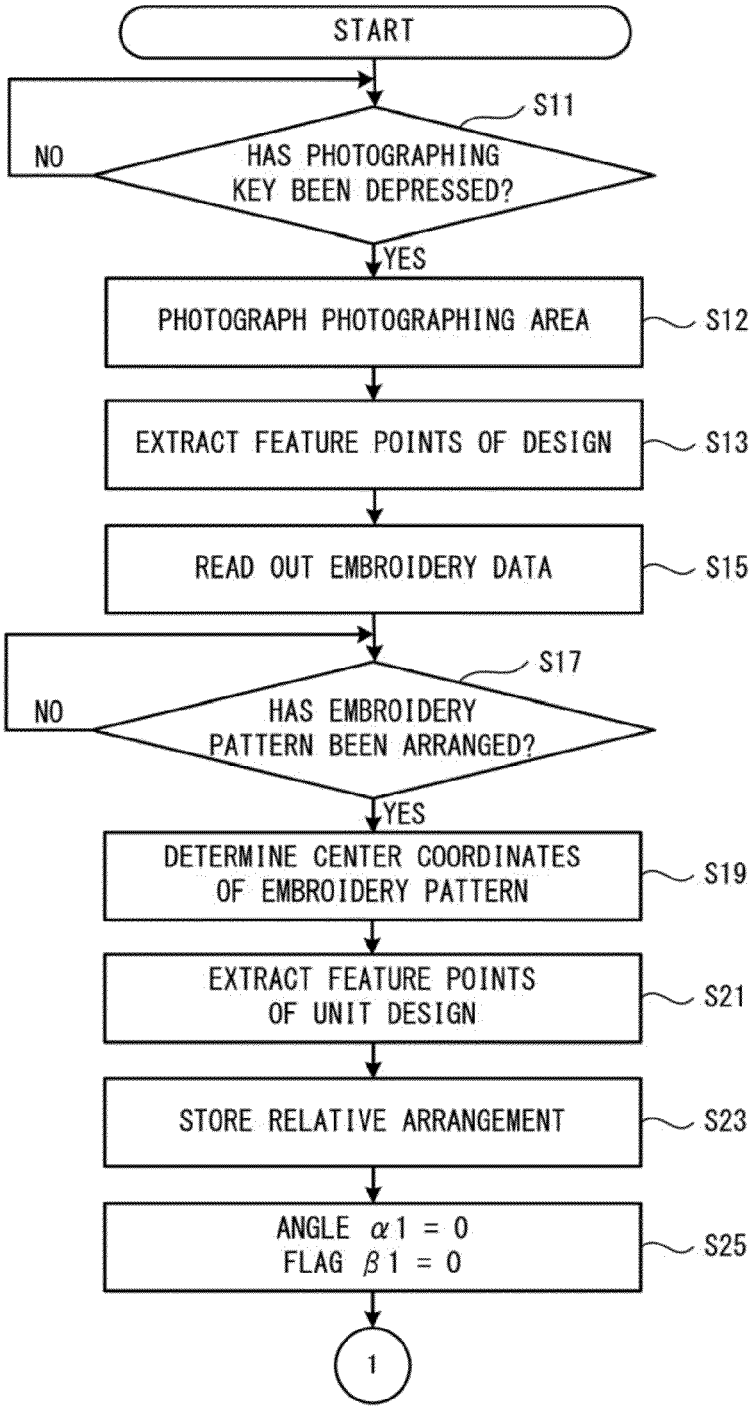
FIG. 4 is a flowchart showing processing based on a sewing program.
Figure 5:
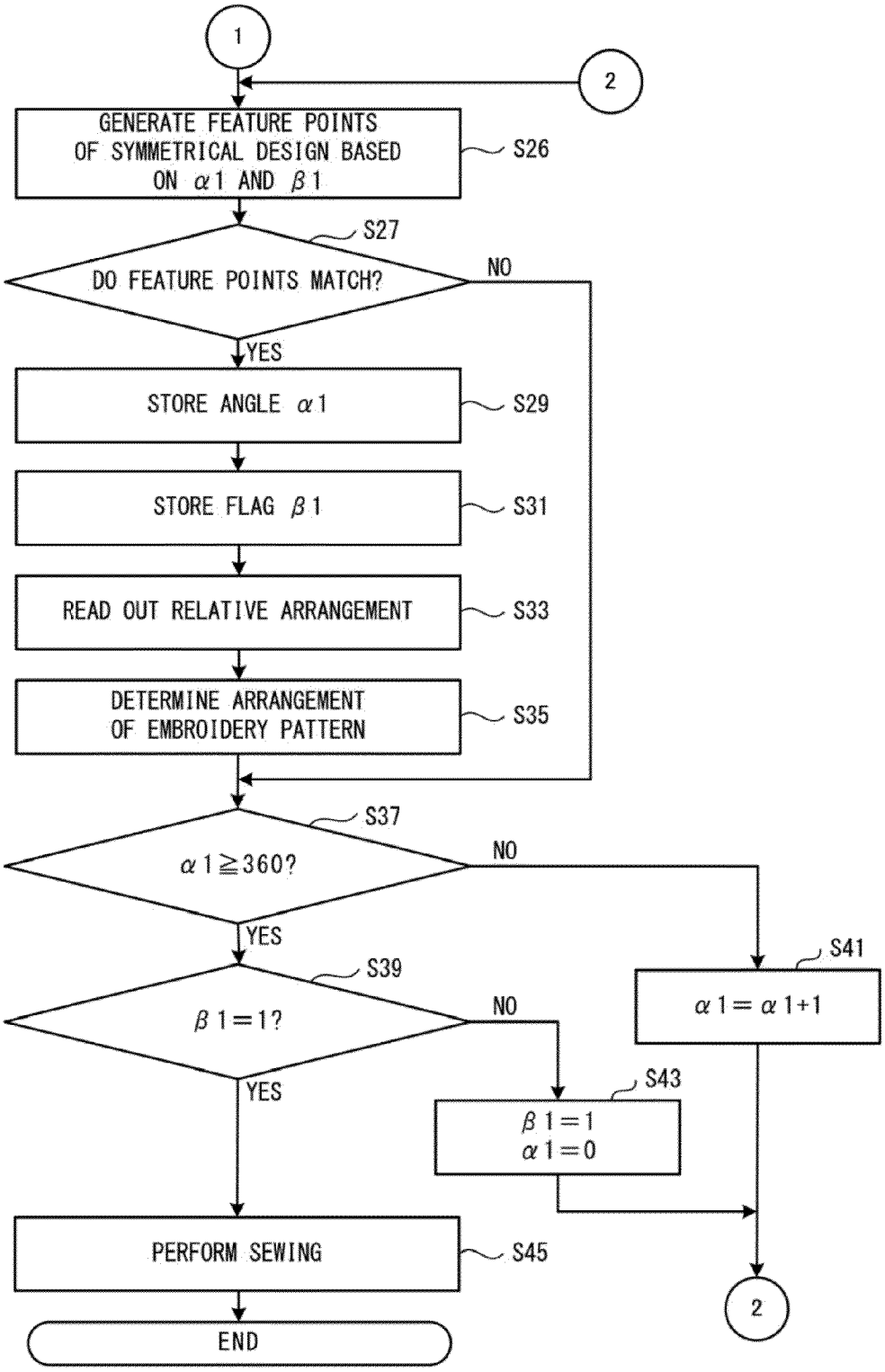
FIG. 5 is a flowchart showing processing based on the sewing program, and is continued from FIG. 4.

An electrical configuration of the sewing machine 101 will be explained with reference to FIG. 3. The control portion 60 of the sewing machine 101 includes a CPU 61, a ROM 62, a RAM 63, a card slot 17, an external access RAM 68, an input interface 65 and an output interface 66, which are mutually connected by a bus 67. The sewing start-and-stop switch 21, the touch panel 26 and the image sensor 50 are connected to the input interface 65. Drive circuits 72, 75, 85 and 86 are connected to the output interface 66. The drive circuit 72 drives a sewing machine motor 79. The drive circuit 75 drives the liquid crystal display 15. The drive circuits 85 and 86 respectively drive the X axis motor 83 and the Y axis motor 84 that move the embroidery frame 34.

The CPU 61 performs main control of the sewing machine 101, and performs various types of calculation and processing in accordance with program data 210 stored in the ROM 62, which is a read-only memory unit. The ROM 62 stores the program data 210 and embroidery data 220. The program data 210 includes a sewing program. The embroidery data 220 is data that indicates an embroidery pattern 120 shown in FIG. 8. The embroidery pattern 120 of the present embodiment is a star-shaped pattern.

The RAM 63 is a memory unit and data can be freely read from and written into the RAM 63. The RAM 63 stores calculation results calculated by the CPU 61. The RAM 63 stores pattern position data 310, captured image data 320 and relative arrangement data 330. The captured image data 320 is data that indicates a captured image 321 that is captured by the image sensor 50. The relative arrangement data 330 is data that indicates a relative arrangement between a position of the embroidery pattern 120 shown in FIG. 8 and feature points 131 of a unit design 130 shown in FIG. 9.

[Sewing Program]

The sewing program will be explained with reference to FIG. 4 to FIG. 12. The sewing program is executed by the CPU 61 of the sewing machine 101. For example, when the user touches the touch panel 26 and selects the desired embroidery pattern 120, the CPU 61 reads the program data 210 from the ROM 62 and executes the sewing program. Each step shown in flowcharts of FIG. 4 and FIG. 5 indicates processing of the CPU 61 that is performed based on the sewing program.

Figure 6:
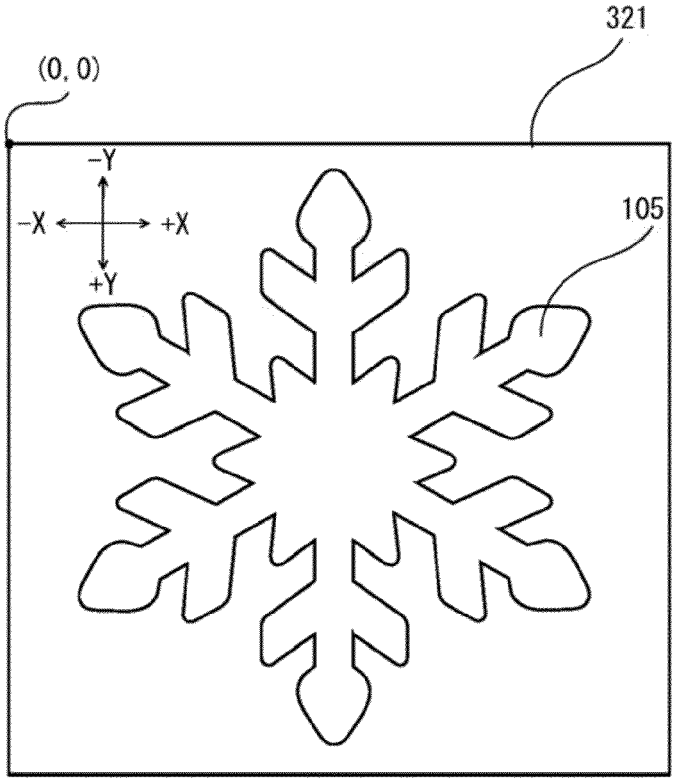
FIG. 6 is a diagram showing a captured image.

In the present embodiment, a design 105 shown in FIG. 6 is printed in advance on the work cloth 100 held by the embroidery frame 34. The design 105 is, for example, a pattern of a snow crystal. In an embroidery coordinate system, the left-right direction of the sewing machine 101 matches the X axis direction and the front-rear direction of the sewing machine 101 matches the Y axis direction. The direction from the left to the right of the sewing machine 101 is an X axis plus direction, and the direction from the rear to the front is a Y axis plus direction.

In the present embodiment, a relative position between an origin position S of the embroidery frame 34 shown in FIG. 1 and the capturing area of the image sensor 50 is set in advance. That is, the embroidery frame 34 is located in the origin position S. The capturing area is located in front of a needle drop point of the sewing needle 7, on the top surface of the work cloth 100. The origin position S of the embroidery frame 34 is a position in which the central position of the sewable area set inside the embroidery frame 34 matches the needle drop point of the sewing needle 7. The needle drop point of the sewing needle 7 is a point at which the sewing needle 7 pierces the work cloth 100 when the sewing needle 7 moves downward.

At step S11, the CPU 61 determines whether or not a capturing key (not shown in the drawings) displayed on the liquid crystal display 15 has been depressed. When the CPU 61 determines that the capturing key has been depressed (yes at step S11), the CPU 61 advances the processing to step S12. When the CPU 61 determines that the capturing key has not been depressed (no at step S11), the CPU 11 repeats the processing at step S11.

At step S12, the CPU 61 causes the image sensor 50 to capture an image of the capturing area. Specifically, the CPU 61 outputs a capturing command to the image sensor 50. When the image sensor 50 receives the capturing command, the image sensor 50 captures the image of the capturing area inside the embroidery frame 34. As shown in FIG. 6, the capturing area includes the design 105 that has been formed in advance on the work cloth 100. The CPU 61 causes the RAM 63 to store, as the captured image data 320, the captured image 321 obtained by capturing the capturing area.

Figure 7:
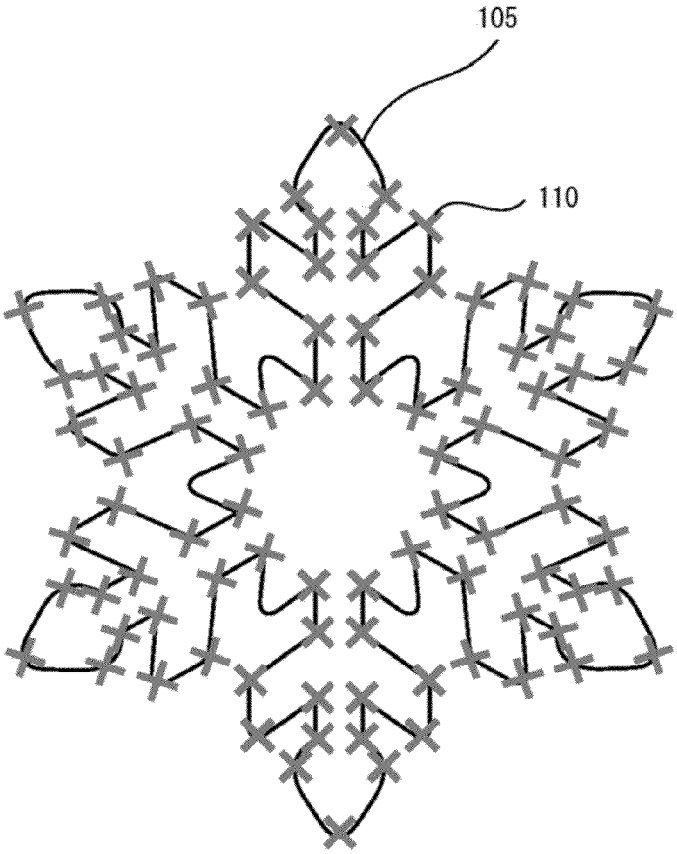
FIG. 7 is a diagram showing feature points of a design in the captured image.

At step S13, as shown in FIG. 7, the CPU 61 extracts feature points 110 of the design 105 based on the captured image 321 captured by the image sensor 50. Although, as shown in FIG. 6, the upper left vertex of the captured image 321 is the origin of the coordinates in the present embodiment, the origin of the coordinates may be changed as appropriate. Specifically, the CPU 61 reads the captured image data 320 from the RAM 63. The CPU 61 extracts the feature points 110 of the design 105 by performing image processing of a known technology. The CPU 61 causes the RAM 63 to store the extracted feature points 110. The feature points 110 are coordinates of points at which the contour line of the design 105 curves at a predetermined angle or more. In FIG. 7, the feature points 110 are shown by points that are indicated by "X".

A method for extracting the feature points 110 will be specifically explained. First, the CPU 61 extracts straight lines from the captured image 321. The well-known Hough transform is used to extract the straight lines. The CPU 61 performs Sobel filter processing on the captured image 321, and generates an edge intensity image that indicates positions at which the density value of the image rapidly changes. The CPU 61 binarizes the edge intensity image and produces an edge point sequence image. The CPU 61 performs the Hough transform on the edge point sequence image, and generates a Hough transformed image. The CPU 61 performs non-maximum suppression processing on the Hough transformed image, and extracts locally bright points in the Hough transformed image. The CPU 61 performs inverse Hough transform processing on bright points, of the extracted bright points, that are brighter than a predetermined threshold value, and thus extracts the straight lines. The CPU 61 calculates intersection points of the extracted straight lines, and extracts the intersection points as the feature points 110 of the design 105.

At step S15, the CPU 61 reads the embroidery data 220 from the ROM 62.

After that, the CPU 61 extracts, from among the feature points 110 extracted at step S13, feature points of the unit design 130 that is a part of the design 105. Specifically, the CPU 61 performs processing at step S17, step S19 and step S21.

Figure 8:
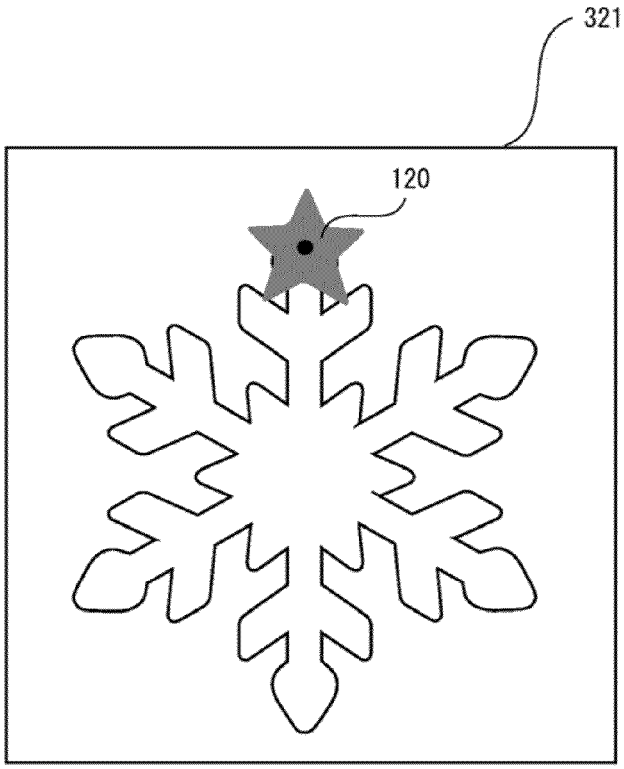
FIG. 8 is a diagram showing an arrangement of an embroidery pattern that is added to the inside of the captured image.

At step S17, as shown in FIG. 8, the CPU 61 determines whether or not the embroidery pattern 120 has been arranged on the captured image 321 captured by the image sensor 50. Specifically, the CPU 61 causes the liquid crystal display 15 to display the captured image 321. The user uses a finger or a touch pen to touch a desired position of the touch panel 26 on the liquid crystal display 15 on which the captured image 321 is displayed, and thus specifies the position of the star-shaped embroidery pattern 120. The CPU 61 detects contact of the finger or the touch pen with the touch panel 26, and receives the specification of the position of the embroidery pattern 120. When the position of the embroidery pattern 120 is received, the CPU 61 determines that the embroidery pattern 120 has been arranged (yes at step S17), and advances the processing to step S19. When the CPU 61 determines that the embroidery pattern 120 has not been arranged (no at step S17), the CPU 61 repeats the processing at step S17.

At step S19, the CPU 61 determines center coordinates 121 of the embroidery pattern 120. Specifically, the CPU 61 determines coordinates of a specific position of the embroidery pattern 120 as the center coordinates 121. The specific position of the embroidery pattern 120 is, for example, the central position of mask data of the embroidery pattern 120. The mask data is data of a smallest rectangle that contains the whole of the embroidery pattern 120. The CPU 61 causes the RAM 63 to store the center coordinates 121 of the embroidery pattern 120, as the pattern position data 310.

Figure 9:
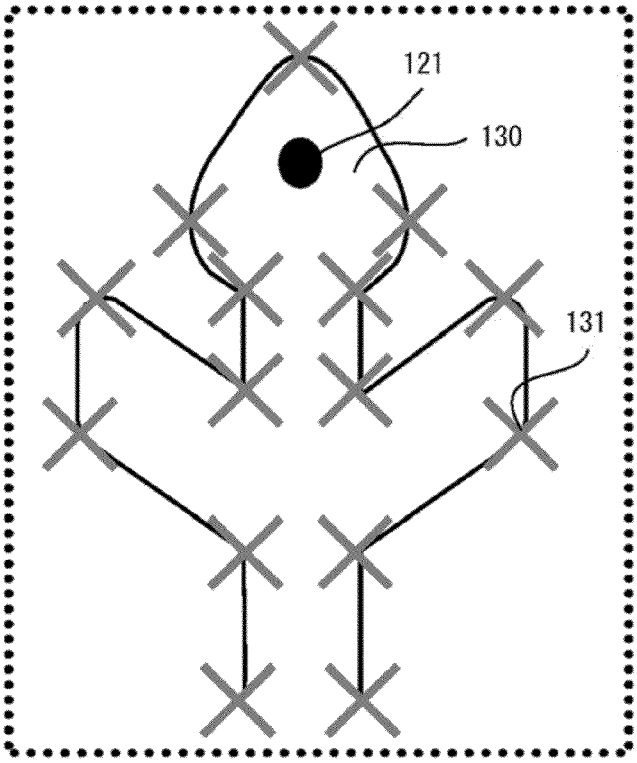
FIG. 9 is a diagram showing a unit design.

At step S21, as shown in FIG. 9, the CPU 61 extracts the feature points 131 of the unit design 130 from among the feature points 110 extracted at step S13. The unit design 130 is a design that is located around the center coordinates 121 determined at step S19. The location around the center coordinates 121 indicates feature points within a predetermined range with respect to the center coordinates 121. The predetermined range is, for example, a rectangular area with respect to the center coordinates 121. The predetermined range is not limited to the rectangular area, and for example, may be an area inside a circle of a radius $\gamma$ whose center point is the center coordinates 121. The radius $\gamma$ may be a value that is set in advance or a value that is set by the user as appropriate. The CPU 61 causes the RAM 63 to store the extracted feature points 131.

At step S23, the CPU 61 causes the RAM 63 to store, as the relative arrangement data 330, a relative arrangement between the center coordinates 121 determined at step S19 and the feature points 131 extracted at step S21. The relative arrangement between the center coordinates 121 and the feature points 131 is, for example, a relative positional relationship in terms of coordinates between the center coordinates 121 and the feature points 131.

At step S25, the CPU 61 initializes an angle $\alpha 1$ and a flag $\beta 1$. Specifically, the CPU 61 sets the angle $\alpha 1$ and the flag $\beta 1$ to 0, respectively. The angle $\alpha 1$ indicates an angle by which the unit design 130 is to be rotated. The flag $\beta 1$ is a flag indicating whether or not to invert the unit design 130. If the flag $\beta 1=0$, it indicates that the unit design 130 is not to be inverted. If the flag $\beta 1=1$, it indicates that the unit design 130 is to be inverted.

At step S26, the CPU 61 generates feature points of a symmetrical design based on the feature points 131 extracted at step S21. The symmetrical design is a design that is symmetrical to the unit design 130. Specifically, the CPU 61 causes the extracted feature points 131 to rotate around a given first point by a rotation angle indicated by the angle $\alpha 1$. For example, among the extracted feature points 131, the first point may be the feature point 131 that is closest to the center coordinates 121, or may be the feature point 131 whose X coordinate value and Y coordinate value are smallest.

When the flag $\beta 1=0$, the CPU 61 does not invert the feature points 131 rotated by the angle $\alpha 1$. When the flag $\beta 1=1$, the CPU 61 inverts the feature points 131 rotated by the angle $\alpha 1$, with respect to a virtual reference line that passes through a given second point. For example, the second point may be a given one of the extracted feature points 131, or a point that is set by the user as appropriate. For example, the virtual reference line may be a line in the Y direction that passes through the second point, a line in the X direction that passes through the second point, or a line that is set by the user as appropriate.

In the present embodiment, when the flag $\beta 1=1$, the CPU 61 inverts the feature points 131 of the unit design 130 in the left-right direction, with respect to the center line that extends in the up-down direction passing through the center coordinates 121. For example, when the feature point (X0, Y0) exists, if it is inverted in the X direction (the left-right direction) with respect to the center line of $X=\Delta$, the feature point $(2\Delta-X0, Y0)$ is obtained.

Figure 10:
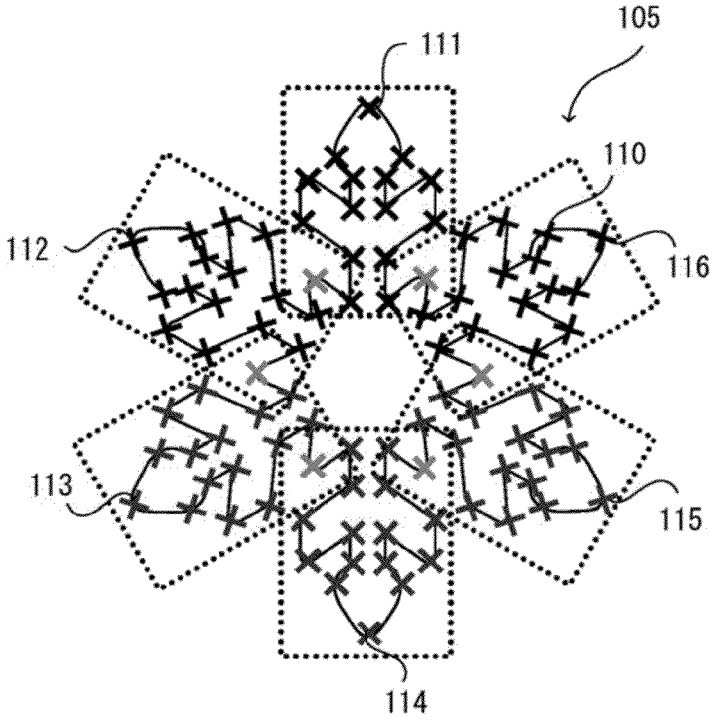
FIG. 10 is a diagram showing pattern position data.

At step S27, as shown in FIG. 10, the CPU 61 determines whether or not the feature points of the symmetrical design generated at step S26 match the feature points 110 of the design 105 extracted at step S13. Specifically, the CPU 61 performs the above-described determination by performing image processing based on template matching or feature matching etc. of the known technology. When the CPU 61 determines that the feature points of the symmetrical design match the feature points 110 of the design 105 (yes at step S27), the CPU 61 advances the processing to step S29. When the CPU 61 determines that the feature points of the symmetrical design do not match the feature points 110 of the design 105 (no at step S27), the CPU 61 advances the processing to step S37. The above-described "match" includes an "almost match" in which an error is equal to or smaller than a predetermined threshold value.

The image processing to cross-check the feature points will be specifically explained. The CPU 61 cross-checks the feature points of the symmetrical design and the feature points 110 of the design 105, using known image processing described in Japanese Laid-Open Patent Publication No. 62-92085, for example. In more detail, the CPU 61 calculates a coincidence rate (%) of the feature points of the symmetrical design and the feature points 110 of a part of the design 105. When the coincidence rate is smaller than a predetermined threshold value, the CPU 61 determines that the feature points do not match. When the coincidence rate is equal to or larger than the predetermined threshold value, the CPU 61 determines that the feature points match.

The CPU 61 may cross-check the feature points of the symmetrical design and the feature points 110 of the design 105, using known image processing described in Japanese Laid-Open Patent Publication No. 8-227459, for example. Specifically, the CPU 61 calculates a distance indicating a difference between each of the feature points of the symmetrical design and each the feature points 110 of a part of the design 105. The CPU 61 calculates a total value by adding the distances between the respective feature points. When the total value is equal to or larger than a predetermined threshold value, the CPU 61 determines that the feature points do not match. When the total value is smaller than the predetermined threshold value, the CPU 61 determines that the feature points match. As long as the feature points can be cross-checked, another method may be used instead of the above-described methods.

At step S29, the CPU 61 causes the RAM 63 to store the angle $\alpha 1$ when it is determined at step S27 that the feature points match, as an angle $\alpha 2$ of the pattern position data 310 shown in FIG. 11. For example, the angle $\alpha 2$ is a direction in which the angle increases in the counterclockwise direction when feature points (first feature points 111) of the unit design 130 that is facing upward are taken as 0 degrees, as shown in FIG. 10.

In the present embodiment, as shown in FIG. 10, the feature points 110 of the design 105, for which the CPU 61 determines at step S27 that the feature points match, are six groups of feature points. The six groups of feature points include first feature points 111, second feature points 112, third feature points 113, fourth feature points 114, fifth feature points 115 and sixth feature points 116. The first feature points 11I match the feature points 131 that are rotated by 0 degrees. The second feature points 112 match the feature points 131 that are rotated by 60 degrees. The third feature points 113 match the feature points 131 that are rotated by 120 degrees. The fourth feature points 114 match the feature point 131 that are rotated by 180 degrees. The fifth feature points 115 match the feature point 131 that are rotated by 240 degrees. The sixth feature points 116 match the feature point 131 that are rotated by 300 degrees.

As shown in FIG. 11, the pattern position data 310 is data relating to the position of the embroidery pattern 120. Specifically, in the pattern position data 310, the angle α2, a flag β2 and the center coordinates 121 are mutually associated with each other. In the present embodiment, six pieces of the pattern position data 310 that correspond to the six groups of feature points shown in FIG. 10 are stored in the RAM 63. More specifically, the angles α2 of the six pieces of the pattern position data 310 are 0 degrees, 60 degrees, 120 degrees, 180 degrees, 240 degrees and 300 degrees, respectively.

At step S31, the CPU 61 causes the RAM 63 to store the flag β1 when it is determined at step S27 that the feature points match, as the flag β2 of the pattern position data 310 shown in FIG. 11. In the present embodiment, the flags β2 of the six pieces of the pattern position data 310 are all zero.

At step S33, the CPU 61 reads, from the RAM 63, the relative arrangement data 330 that indicates the relative arrangement between the center coordinates 121 and the feature points 131.

Figure 12:
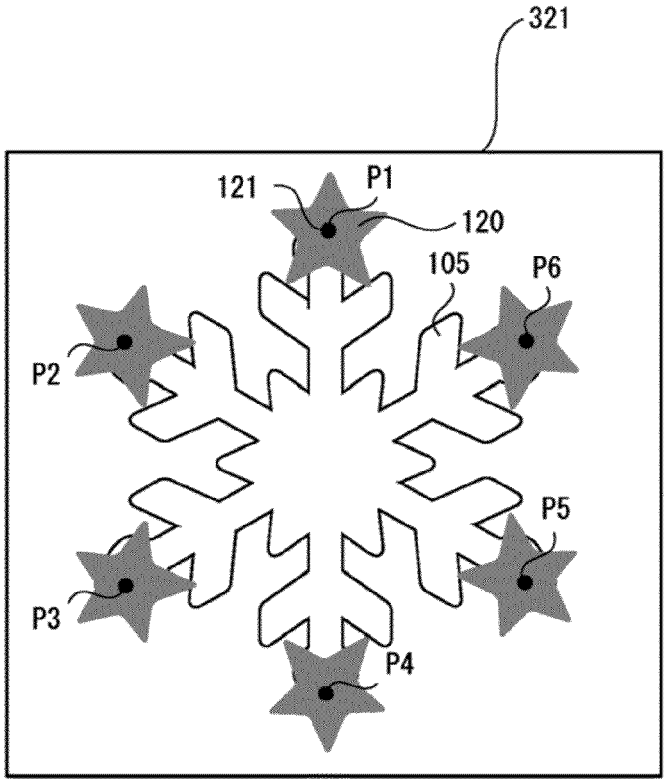
FIG. 12 is a diagram showing an arrangement of embroidery patterns 120 that each correspond to a design that is symmetrical to the unit design in the captured image.

At step S35, the CPU 61 determines the arrangement of the embroidery pattern 120 with respect to the symmetrical design, based on the result of the cross-check at step S27. As shown in FIG. 12, the CPU 61 calculates the center coordinates 121 of the embroidery pattern 120 for the symmetrical design, based on the relative arrangement data 330 read from the RAM 63.

In more detail, based on the arrangement between the center coordinates 121 and the feature points 131 that is shown by the relative arrangement data 330, the CPU 61 calculates coordinates corresponding to the center coordinates 121 in a case where the feature points of the symmetrical design are assumed to be the feature points 131 of the unit design 130. In other words, the calculated coordinates are the center coordinates of the embroidery pattern 120 for the symmetrical design. The CPU 61 causes the RAM 63 to store the calculated center coordinates as the center coordinates 121 of the pattern position data 310 shown in FIG. 11. In the present embodiment, the center coordinates 121 of the six pieces of the pattern position data 310 are coordinates P1, P2, P3, P4, P5 and P6 shown in FIG. 12, respectively.

Further, the CPU 61 reads the pattern position data 310 from the RAM 63. The CPU 61 determines the arrangement of the embroidery pattern 120 in accordance with the angle α2, the flag β2 and the center coordinates 121, for each piece of the read pattern position data 310. Specifically, in the same manner as when the feature points 131 of the unit design 130 are rotated, the CPU 61 rotates the embroidery pattern 120 by the rotation angle indicated by the angle α2 of the pattern position data 310. When the flag 32 of the pattern position data 310 is equal to 1, the CPU 61 inverts the embroidery pattern 120 in the same manner as when the feature points 131 of the unit design 130 are inverted. After that, the CPU 61 determines coordinate positions of points that form the embroidery pattern 120 such that the center coordinates of the embroidery pattern 120 on which at least one of rotation and inversion has been performed match the center coordinates 121 of the embroidery position data 310. The CPU 61 causes the RAM 63 to store the determined coordinate positions of the points that form the embroidery pattern 120, as embroidery data indicating the arrangement of the embroidery pattern 120.

At step S37, the CPU 61 determines whether or not the search for all the angles is completed. Specifically, the CPU 61 determines whether or not the angle α1 is equal to or larger than 360 degrees. When the CPU 61 determines that the angle α1 is equal to or larger than 360 degrees (yes at step S37), the CPU 61 advances the processing to step S39. When the CPU 61 determines that the angle α1 is smaller than 360 degrees (no at step S37), the CPU 61 advances the processing to step S41.

At step S39, the CPU 61 determines whether or not all the angles including an inverted state have been searched. Specifically, the CPU 61 determines whether or not the flag β1 is equal to 1. When the CPU 61 determines that the flag β1 is equal to 1 (yes at step S39), the CPU 61 advances the processing to step S45. When the CPU 61 determines that the flag β1 is not equal to 1 (no at step S39), the CPU 61 advances the processing to step S43.

At step S41, the CPU 61 adds 1 degree to the angle α1. After that, the CPU 61 returns the processing to step S26.

At step S43, the CPU 61 sets the flag β1 to 1. In order to search all the angles again based on the unit design 130 in an inverted state, the CPU 61 initializes the angle α1. Specifically, the CPU 61 sets the angle α1 to 0. After that, the CPU 61 returns the processing to step S26.

At step S45, the CPU 61 instructs the sewing portion to sew the embroidery pattern 120 based on the arrangement of the embroidery pattern 120 determined at step S35 and on the relative position of the capturing area with respect to the embroidery frame 34. The sewing portion receives the instruction, causes the embroidery frame 34 to move in the X direction and the Y direction, and sews the embroidery pattern 120 on the work cloth 100. The meaning of "sewing" is driving the X axis motor 83 and the Y axis motor 84, causing the embroidery frame moving device 92 to move the embroidery frame 34 in the X direction and the Y direction, and vertically reciprocating the needle bar 6 by driving the sewing machine motor 79. The sewing portion includes the drive circuits 72, 85 and 86.

After step S45 is completed, the CPU 61 ends the processing that is based on the sewing program. In the manner described above, in accordance with the arrangement of the embroidery patterns 120 shown in FIG. 12, it is possible to sew the six embroidery patterns 120 beautifully and with a good appearance, with respect to the design 105 that has been formed (printed) in advance on the work cloth 100.

Examples of Effects of the Present Embodiment

At step S7, the captured image 321 is displayed on the liquid crystal display 15. The user specifies the position in which the embroidery pattern 120 is to be arranged, by touching the touch panel 26 on the liquid crystal display 15 on which the captured image 321 is displayed. Therefore, the user can easily arrange the embroidery pattern 120 in a desired position.

At step S21, the CPU 61 extracts, as the feature points 131 of the unit design 130, the feature points of the design located around the center coordinates 121 of the embroidery pattern 120. Therefore, the user can determine the unit design 130 that will be a target of cross checking, simply by specifying the position of the embroidery pattern 120.

At step S41, the CPU 61 rotates the feature points 131 by 1 degree at a time until the feature points 131 of the unit design 130 are rotated by 360 degrees. Every time the feature points 131 are rotated by 1 degree, the CPU 61 determines at step S27 whether or not the feature points 131 of the unit design 130 match the feature points 110 of the design 105. It is thus possible to accurately perform determination of rotational symmetry.

At step S43, when the feature points 131 of the unit design 130 are rotated by 360 degrees, the CPU 61 inverts the feature points 131 of the unit design 130. Every time the feature points 131 are rotated by 1 degree, the CPU 61 determines at step S27 whether or not the feature points 131 of the unit design 130 match the feature points 110 of the design 105. It is thus possible to accurately perform determination of line symmetry.

Modified Examples

The present disclosure is not limited to the above-described embodiment, and can be performed in various forms without departing from the spirit of the present disclosure.

Figure 13:
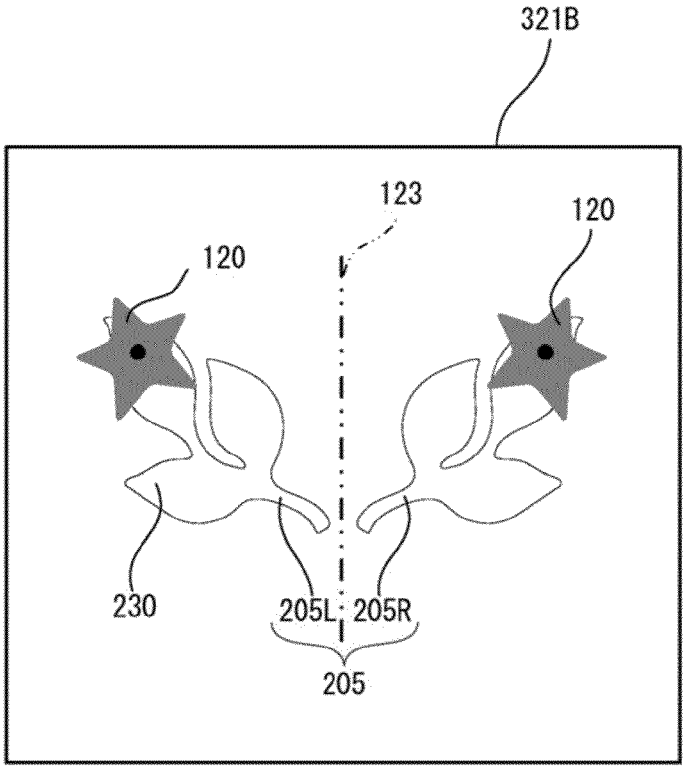
FIG. 13 is a diagram showing an arrangement of embroidery patterns that each correspond to another design in the captured image.

In the present embodiment, the design 105 of the work cloth 100 is a shape having rotational symmetry. However, a design with a shape that is line-symmetric in the left-right direction, such as a design 205 shown in FIG. 13, may be used. FIG. 13 shows a captured image 321B of the design 205 that is captured by the image sensor 50. The design 205 includes a left side design 205L and a right side design 205R. The left side design 205L and the right side design 205R are line-symmetric (left-right inverted) with respect to a virtual straight line 123 that extends in the Y direction.

The user arranges the embroidery pattern 120 such that it is overlapped with a part of the left side design 205L. At step S21, the CPU 61 extracts feature points of a unit design 230 based on the position of the embroidery pattern 120. In order to make the explanation simple, it is assumed that the design 205L and the unit design 230 are the same. First, the CPU 61 repeatedly performs the processing at steps S26, S27, S37 and S41 without inverting the feature points of the unit design 230, and cross-checks the feature points of the unit design 230 with feature points of the right side design 205R. In this case, even when the angle $\alpha 1$ is rotated by 360 degrees, the feature points do not match (no at step S27). Therefore, the CPU 61 inverts the feature points of the unit design 230 in the left-right direction with respect to the virtual straight line 123 (yes at step S37, no at step S39, and step S43).

Next, the CPU 61 repeatedly performs steps S26, S27, S37 and S41, and cross-checks the feature points of the inverted unit design 230, which has been inverted in the left-right direction, with the feature points of the right side design 205R. In this case, the CPU 61 determines that the right side design 205R matches the unit design 230 (yes at step S27). The CPU 61 performs steps S29 to S35, and automatically arranges the embroidery pattern 120 with respect to the right side design 205R, based on the arrangement between the left side design 205L and the embroidery pattern 120. Note that the design on the work cloth 100 need not necessarily be a design with a shape that is line-symmetric in the left-right direction as described above, and may be a design with a shape that is line-symmetric in the up-down direction.

Although the lock stitch sewing machine 101 is exemplified in the present embodiment, a multi-needle sewing machine may be used.

In the sewing machine 101, various functions are achieved by the CPU 61 executing the program data 210 stored in the ROM 62. Note that the program data 210 is written into the ROM 62 when the sewing machine 101 is shipped from a factory. The ROM 62 is an example of a computer-readable storage device. For example, an HDD, a RAM or the like may be used as a storage device, in place of the ROM 62. In this case, the storage device is a non-transitory storage medium. The non-transitory storage medium can retain data irrespective of the length of time during which the data is stored. The program data 210 may be saved in a storage medium, such as an external server. When the program data 210 is stored in a server, the program data 210 is downloaded from an external server or the like via a connection interface, and is stored in the sewing machine 101 as appropriate. In this case, the program data 210 is transmitted as a transmission signal to the sewing machine 101 from the external server or the like that is a non-transitory computer-readable storage medium.

In the present embodiment, the processing that extracts the feature points 110 of the design 105, the processing that extracts the feature points 131 of the unit design 130, the processing that cross-checks the coordinates indicating the feature points 110 of the design 105 and the coordinates indicating the feature points of a design that is symmetrical to the unit design 130, and the processing that determines the arrangement of the embroidery pattern 120 with respect to the design that is symmetrical to the unit design 130 are achieved by software executed by the CPU 61. However, each processing may be achieved by hardware.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an image capturing portion configured to capture an image of a design that is formed in advance on a work cloth;

a sewing portion configured to sew an embroidery pattern;

a processor; and a memory configured to store computer-readable instructions, the computer-readable instructions, when executed by the processor, causing the sewing machine to perform operations comprising:

extracting feature points of the design based on the image captured by the image capturing portion;

extracting, from among the extracted feature points of the design, feature points of a unit design, the unit design being a part of the design;

generating, based on the extracted feature points of the unit design, feature points of a symmetrical design, the symmetrical design being a design symmetrical to the unit design;

cross-checking the extracted feature points of the design and the generated feature points of the symmetrical design;

determining an arrangement of the embroidery pattern with respect to the symmetrical design, based on a result obtained by the cross-checking the feature points of the design and the feature points of the symmetrical design; and causing the sewing portion to sew the embroidery pattern based on the determined arrangement of the embroidery pattern with respect to the symmetrical design.

2. The sewing machine according to claim 1, wherein the extracting the feature points of the unit design comprises:

receiving specification of a position of the embroidery pattern on the image captured by the image capturing portion; and extracting feature points of a part of the design as the feature points of the unit design, based on the received position of the embroidery pattern.

3. The sewing machine according to claim 2, wherein the extracting the feature points of the unit design based on the received position of the embroidery pattern comprises:

determining a specific position that corresponds to the received position of the embroidery pattern; and extracting, from among the extracted feature points of the design, feature points of a part of the design located around the determined specific position, as the feature points of the unit design.

4. The sewing machine according to claim 2, wherein the extracting the feature points of the unit design comprises causing a storage portion to store a relative arrangement between the received position of the embroidery pattern and the extracted feature points of the unit design, after the feature points of the unit design have been extracted, and wherein the determining the arrangement of the embroidery pattern comprises determining the arrangement of the embroidery pattern with respect to the symmetrical design, based on the relative arrangement between the position of the embroidery pattern and the feature points of the unit design, the relative arrangement being read from the storage portion.

5. The sewing machine according to claim 1, wherein the cross-checking the feature points of the design and the feature points of the symmetrical design comprises:

rotating the extracted feature points of the unit design by a plurality of different rotation angles; and determining whether the rotated feature points of the unit design match a part of the extracted feature points of the design, and wherein the determining the arrangement of the embroidery pattern comprises determining the arrangement of the embroidery pattern with respect to the symmetrical design, based on a rotation angle of the feature points of the unit design that have been determined to match a part of the feature points of the design.

6. The sewing machine according to claim 1, wherein the cross-checking the feature points of the design and the feature points of the symmetrical design comprises:

inverting the extracted feature points of the unit design when a predetermined condition is satisfied; and determining whether the inverted feature points of the unit design or the feature points of the unit design that have not been inverted match a part of the extracted feature points of the design, and wherein the determining the arrangement of the embroidery pattern comprises determining the arrangement of the embroidery pattern with respect to the symmetrical design, based on whether the feature points of the unit design that have been determined to match a part of the feature points of the design have been inverted.

7. A non-transitory computer-readable medium storing a sewing program, the sewing program comprising computer-readable instructions to be executed by a processor of a sewing machine, the sewing machine including an image capturing portion and a sewing portion, the image capturing portion being configured to capture an image of a design that is formed in advance on a work cloth, the sewing portion being configured to sew an embroidery pattern, the sewing program including computer-readable instructions to cause the processor to perform the steps of:

extracting feature points of the design based on the image captured by the image capturing portion;

extracting, from among the extracted feature points of the design, feature points of a unit design, the unit design being a part of the design;

generating, based on the extracted feature points of the unit design, feature points of a symmetrical design, the symmetrical design being is a design symmetrical to the unit design;

cross-checking the extracted feature points of the design and the generated feature points of the symmetrical design;

determining an arrangement of the embroidery pattern with respect to the symmetrical design, based on a result obtained by the cross-checking the feature points of the design and the feature points of the symmetrical design; and causing the sewing portion to sew the embroidery pattern based on the determined arrangement of the embroidery pattern with respect to the symmetrical design.

8. The non-transitory computer-readable medium according to claim 7, wherein the extracting the feature points of the unit design comprises:

receiving specification of a position of the embroidery pattern on the image captured by the image capturing portion; and extracting feature points of a part of the design as the feature points of the unit design, based on the received position of the embroidery pattern.

9. The non-transitory computer-readable medium according to claim 8, wherein the extracting the feature points of the unit design based on the received position of the embroidery pattern comprises:

determining a specific position that corresponds to the received position of the embroidery pattern; and extracting, from among the extracted feature points of the design, feature points of a part of the design located around the determined specific position, as the feature points of the unit design.

10. The non-transitory computer-readable medium according to claim 8, wherein the extracting the feature points of the unit design comprises causing a storage portion to store a relative arrangement between the received position of the embroidery pattern and the extracted feature points of the unit design, after the feature points of the unit design have been extracted, and wherein the determining the arrangement of the embroidery pattern comprises determining the arrangement of the embroidery pattern with respect to the symmetrical design, based on the relative arrangement between the position of the embroidery pattern and the feature points of the unit design, the relative arrangement being read from the storage portion.

11. The non-transitory computer-readable medium according to claim 7, wherein the cross-checking the feature points of the design and the feature points of the symmetrical design comprises:

rotating the extracted feature points of the unit design by a plurality of different rotation angles; and determining whether the rotated feature points of the unit design match a part of the extracted feature points of the design, and wherein the determining the arrangement of the embroidery pattern comprises determining the arrangement of the embroidery pattern with respect to the symmetrical design, based on a rotation angle of the feature points of the unit design that have been determined to match a part of the feature points of the design.

12. The non-transitory computer-readable medium according to claim 7, wherein the cross-checking the feature points of the design and the feature points of the symmetrical design comprises:

inverting the extracted feature points of the unit design when a predetermined condition is satisfied; and determining whether the inverted feature points of the unit design or the feature points of the unit design that have not been inverted match a part of the extracted feature points of the design, and wherein the determining the arrangement of the embroidery pattern comprises determining the arrangement of the embroidery pattern with respect to the symmetrical design, based on whether the feature points of the unit design that have been determined to match a part of the feature points of the design have been inverted.

13. A sewing method comprising:

extracting feature points of a design based on an image captured by an image capturing portion, the image capturing portion being configured to capture the image of the design that is formed in advance on a work cloth;

extracting, from among the extracted feature points of the design, feature points of a unit design, the unit design being a part of the design;

generating, based on the extracted feature points of the unit design, feature points of a symmetrical design, the symmetrical design being a design symmetrical to the unit design;

cross-checking the extracted feature points of the design and the generated feature points of the symmetrical design;

determining an arrangement of an embroidery pattern with respect to the symmetrical design, based on a result obtained by the cross-checking the feature points of the design and the feature points of the symmetrical design; and causing a sewing portion to sew the embroidery pattern based on the determined arrangement of the embroidery pattern with respect to the symmetrical design, the sewing portion being configured to sew an embroidery pattern.

14. The sewing method according to claim 13, wherein the extracting the feature points of the unit design comprises:

receiving specification of a position of the embroidery pattern on the image captured by the image capturing portion; and extracting feature points of a part of the design as the feature points of the unit design, based on the received position of the embroidery pattern.

15. The sewing method according to claim 14, wherein the extracting the feature points of the unit design based on the received position of the embroidery pattern comprises:

determining a specific position that corresponds to the received position of the embroidery pattern; and extracting, from among the extracted feature points of the design, feature points of a part of the design located around the determined specific position, as the feature points of the unit design.

16. The sewing method according to claim 14, wherein the extracting the feature points of the unit design comprises causing a storage portion to store a relative arrangement between the received position of the embroidery pattern and the extracted feature points of the unit design, after the feature points of the unit design have been extracted, and wherein the determining the arrangement of the embroidery pattern comprises determining the arrangement of the embroidery pattern with respect to the symmetrical design, based on the relative arrangement between the position of the embroidery pattern and the feature points of the unit design, the relative arrangement being read from the storage portion.

17. The sewing method according to claim 13, wherein the cross-checking the feature points of the design and the feature points of the symmetrical design comprises:

rotating the extracted feature points of the unit design by a plurality of different rotation angles; and determining whether the rotated feature points of the unit design match a part of the extracted feature points of the design, and wherein the determining the arrangement of the embroidery pattern comprises determining the arrangement of the embroidery pattern with respect to the symmetrical design, based on a rotation angle of the feature points of the unit design that have been determined to match a part of the feature points of the design.

18. The sewing method according to claim 13, wherein the cross-checking the feature points of the design and the feature points of the symmetrical design comprises:

inverting the extracted feature points of the unit design when a predetermined condition is satisfied; and determining whether the inverted feature points of the unit design or the feature points of the unit design that have not been inverted match a part of the extracted feature points of the design, and wherein the determining the arrangement of the embroidery pattern comprises determining the arrangement of the embroidery pattern with respect to the symmetrical design, based on whether the feature points of the unit design that have been determined to match a part of the feature points of the design have been inverted.

* * * * *